United States Patent [19]

Butterworth et al.

[11] Patent Number: 4,622,154

[45] Date of Patent: Nov. 11, 1986

[54] AQUEOUS FABRIC SOFTENING COMPOSITION

[75] Inventors: Robert M. Butterworth; John R. Martin; Edwin Willis, all of Merseyside, England

[73] Assignee: Lever Brothers Company, New York, N.Y.

[21] Appl. No.: 719,677

[22] Filed: Apr. 4, 1985

[30] Foreign Application Priority Data

Apr. 19, 1984 [GB] United Kingdom ..... 8410320

[51] Int. Cl.[4] ..... D06M 1/00

[52] U.S. Cl. ..... 252/8.8; 252/8.6

[58] Field of Search ..... 252/8.6, 8.8

[56] References Cited

U.S. PATENT DOCUMENTS

| | | | |
|---|---|---|---|
| 3,451,927 | 6/1969 | Tune et al. | 252/8.75 |
| 3,974,076 | 8/1976 | Wiersema et al. | 252/8.8 |
| 4,351,737 | 9/1982 | Billenstein et al. | 252/8.8 |
| 4,464,273 | 8/1984 | Parslow et al. | 252/8.8 |
| 4,497,716 | 2/1985 | Tai | 252/8.8 |

FOREIGN PATENT DOCUMENTS

| | | |
|---|---|---|
| 4121 | 9/1979 | European Pat. Off. . |
| 22555 | 1/1981 | European Pat. Off. . |
| 23334 | 2/1981 | European Pat. Off. . |
| 0056695 | 7/1982 | European Pat. Off. . |
| 59502 | 9/1982 | European Pat. Off. . |
| 60003 | 9/1982 | European Pat. Off. . |
| 74056 | 3/1983 | European Pat. Off. . |
| 0082456 | 6/1983 | European Pat. Off. . |
| 94118 | 11/1983 | European Pat. Off. . |
| 107479 | 5/1984 | European Pat. Off. . |
| 2905881 | 8/1980 | Fed. Rep. of Germany . |
| 947714 | 1/1964 | United Kingdom . |
| 1084232 | 9/1967 | United Kingdom . |
| 1459935 | 12/1976 | United Kingdom . |
| 1538866 | 1/1979 | United Kingdom . |
| 2115847 | 9/1983 | United Kingdom . |

*Primary Examiner*—Paul Lieberman
*Assistant Examiner*—Willie J. Thompson
*Attorney, Agent, or Firm*—Milton L. Honig; James J. Farrell

[57] ABSTRACT

An aqueous fabric softening composition containing less than 10% cationic softener also includes an alkoxylated fatty amine having up to 7 alkylene oxide groups per molecule, such as ethoxylated tallow amine at exemplified levels of 4.0 to 12.0%. The alkoxylated compound enhances the softening and anti-static properties of the composition.

6 Claims, No Drawings

AQUEOUS FABRIC SOFTENING COMPOSITION

This invention relates to an aqueous fabric softening composition, in particular to a composition containing a water-insoluble cationic fabric softener.

British Patent Specification GB-A-No. 1 104 441 (UNILEVER/TUNE) discloses aqueous fabric softening compositions which contain up to 10% by weight of a water-insoluble cationic fabric softener together with a fatty acid ethanolamide which is included to enhance the softening effect and to provide an anti-static finish on fabrics treated therewith.

We have surprisingly discovered that the benefits of using ethanolamides can also be achieved with alkoxylated fatty amines.

Thus, according to the invention there is provided an aqueous fabric softening composition comprising:

(i) an aqueous base;

(ii) at least 1% to less than 10% by weight of a water-insoluble cationic fabric softener; and (iii) a nonionic material which comprises an alkylene oxide adduct of a fatty amine, the fatty amine containing at least 10 carbon atoms and the adduct containing an average of not more than 7 alkylene oxide groups per molecule, the total level of the cationic fabric softener and the nonionic material being at least 12% by weight.

The level of cationic softener in the composition is preferably more than 6% to less than 10% by weight, most preferably from 7% to about 9% by weight. The level of the nonionic material in the composition is preferably less than 10% by weight, most preferably less than about 8% by weight. The weight ratio of the cationic softener to the nonionic material is preferably at least 1:1, such as between about 1.5:1 and about 5:1.

The water-insoluble cationic fabric softener can be any fabric-substantive cationic compound which has a solubility in water at pH 2.5 and 20° C. of less than 10 g/l. Highly preferred materials are quaternary ammonium salts having two $C_{12}$–$C_{24}$ alkyl or alkenyl chains, optionally substituted or interrupted by functional groups such as —OH, —O—, —CONH, —COO—, etc.

Well known species of substantially water-insoluble quaternary ammonium compounds have the formula

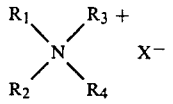

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow)dimethyl ammonium methyl sulfate; dihexadecyl diethyl ammonium chloride; di(coconut alkyl)dimethyl ammonium chloride. Ditallow dimethyl ammonium chloride, di(hydrogenated tallow alkyl)dimethyl ammonium chloride, di(coconut alkyl)- dimethyl ammonium chloride and di(coconut alkyl)-dimethyl ammonium methosulfate are preferred.

Another class of preferred water-insoluble cationic materials are the alkylimidazolinium salts believed to have the formula:

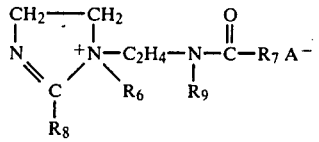

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-)ethyl-2-tallowyl-4,5-dihydro imidazolinium methosulfate and 1-methyl-1-(palmitoylamido)ethyl-2-octadecyl-4,5-dihydroimidazolinium chloride. Other useful imidazolinium materials are 2-heptadecyl-1-methyl-1-(2-stearylamido)ethyl-imidazolinium chloride and 2-lauryl-1-hydroxyethyl-1-oleyl-imidazolinium chloride. Also suitable herein are the imidazolinium fabric softening components of U.S. Pat. No. 4,127,489, incorporated by reference.

Representative commercially available materials of the above classes are the quaternary ammonium compounds Arquad 2HT (ex AKZO); Noramium M2SH (ex CEKA); Aliquat-2HT (Trade Mark of General Mills Inc) and the imidazolinium compounds Varisoft 475 (Trade Mark of Sherex Company, Columbus Ohio) and Rewoquat W7500 (Trade Mark of REWO).

The nonionic material is, or includes, an alkylene oxide adduct of a fatty amine as specified above, but may also include other alkoxylated or non-alkoxylated nonionic materials.

Alkylene oxide adducts of fatty amines useful in the present invention, preferably have the general formula

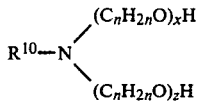

wherein $R^{10}$ is an alkyl or alkenyl group having at least 10 carbon atoms, most preferably from 10 to 22 carbon atoms, n is 2 or 3, and x and z in total are preferably not more than 4.0, most preferably from about 0.5 to about 3.5. Examples of such materials include Ethomeen T12 (tallow amine 2EO, available from AKZO), Optamine PC5 (coconut alkyl amine 5EO) and Crodamet 1.02 (oleylamine 2EO, available from Croda Chemicals).

The viscosity of the product, when measured at 110 $sec^{-1}$ shear rate should be less than about 150 cP, preferably between about 20 and about 100 cP and the product can be added as such to a fabric rinse liquor or may be pre-diluted with water.

Preferably, the compositions of the invention contain substantially no anionic material, in particular no anionic surface active materials. If such materials are present, the weight ratio of the cationic material to the anionic material should preferably be more than 10:1, such as more than 100:1.

The compositions may include electrolytes to assist in controlling the viscosity of the product. A suitable electrolyte level in the compositions is from about 0.01% to about 0.5%, most preferably from about 0.02% to about 0.2%, measured as the anhydrous salt. Examples of suitable materials include the ionic salts of sodium, potassium, lithium, magnesium, calcium or aluminium, such as lithium chloride, sodium chloride, ammonium chloride, sodium methosulphate, sodium benzoate, calcium chloride, magnesium chloride or aluminium chloride. Of these, sodium and potassium salts are less preferred.

The compositions may include low levels of solvents for the cationic fabric softener. Indeed, the cationic raw materials will often include isopropanol as a solvent. It is preferred that the level of isopropanol or any other $C_1$—$C_4$ monohydric alcohol in the composition is less than about 5% by weight, most preferably less than about 2.5% by weight.

Additionally the composition can contain substances for maintaining the stability of the product on cold storage. Examples of such substances include polyhydric alcohols such as ethylene glycol, propylene glycol, glycerol and polyethylene glycol. A suitable level for such materials is from about 0.5% to about 5%, preferably about 0.1% to 2.0% by weight.

The compositions of the invention may further include other additional ingredients including colourants, perfumes, preservations, anti-foams, optical brighteners, opacifiers, pH buffers (the preferred pH for the compositions is between about 3 and about 8, such as from about 4 to about 6), further viscosity modifiers, non-cationic fabric conditioning agents, anti-shrinkage agents, anti-wrinkle agents, fabric crisping agents, spotting agents, soil-release agents, germicides, anti-oxidants and anti-corrosion agents.

The compositions of the invention may be prepared by a variety of methods. One suitable method is to form a molten mixture of the cationic fabric softener and the nonionic material, add this molten mixture to water with stirring to form a dispersion and thereafter adding any optional ingredients.

Alternatively, the alkoxylated amine may be added in molten form to the water containing a strong acid (such as hydrochloric or phosphoric acid, thereby to increase the solubility thereof by formation of a corresponding amine salt. The molten cationic may then be added with stirring to form a dispersion and thereafter optional ingredients are added.

The invention will now be illustrated by the following Examples, where all parts and percentages are by weight. Where commercially available materials are referred to, the percentages quoted are of the active ingredients therein.

EXAMPLE 1

A composition was prepared according to the formulation:

| Ingredient (%) | |
|---|---|
| Arquad 2HT[1] | 8.0 |
| Ethomeen T12[2] | 4.0 |
| Calcium chloride | 0.04 |
| Water and minor ingredients | balance |

[1]A commercially available di-hardened tallow dimethyl ammonium chloride (about 82% active - balance water and isopropanol)
[2]A commercially available ethoxylated tallow amine with an average of about 2 ethylene oxide groups per molecule.

100 g of the composition was prepared by adding molten amine to water containing hydrochloric acid on a 1:1 molar basis relative to the amine and the molten cationic was then added with stirring for 7 minutes at 500 rpm to form a dispersion. The electrolyte was then added in the form of a saturated solution. The composition was cooled and perfume added.

EXAMPLE 2

To demonstrate the effect of the number of alkylene oxide groups in the alkoxylated amine, the following compositions were prepared using the same method as Example 1.

| Ingredients (%) | Example No: 2 | 2A |
|---|---|---|
| Arquad 2HT | 8.0 | 8.0 |
| Ethomeen T12 (2 EO) | 4.0 | — |
| Ethomeen T25 (15 EO) | — | 4.0 |
| Calcium chloride | 0.05 | 0.05 |
| Water | balance | |

The softening performance of these products was evaluated. The test fabrics were terry towelling cotton pieces with a weight of 40 g in 1 liter of treatment liquor at 25° C. in a laboratory scale apparatus, with stirring at 50 rpm. Example 2 showed a performance which was equivalent to the use of Arquad 2HT alone, whereas Example 2A showed a performance which was equivalent to only 53% of the use of Arquad 2HT alone. These results demonstrate the benefit of using an alkoxylated amine in which the number of alkylene oxide groups is not above 7.

We claim:

1. An aqueous fabric softening composition comprising:

(i) an aqueous base;

(ii) at least 1% to less than 10% by weight of a water-insoluble cationic fabric softener; and (iii) a nonionic material which comprises an alkylene oxide adduct of a fatty amine, the fatty amine containing at least 10 carbon atoms and the adduct containing an average of not more than 7 alkylene oxide groups per molecule, the total level of the cationic fabric softener and the nonionic material being at least 12% by weight.

2. An aqueous fabric softening composition according to claim 1, wherein the level of said water-insoluble cationic fabric softener is more than 6% by weight of the composition.

3. An aqueous fabric softening composition according to claim 1, wherein the level of said nonionic material is less than 10% by weight of the composition.

4. An aqueous fabric softening composition according to claim 1, wherein the weight ratio of said cationic fabric softener to said nonionic material is at least 1:1.

5. An aqueous fabric softening composition according to claim 1, further comprising an electrolyte selected from ionic salts of lithium, magnesium, calcium, aluminium and mixtures thereof.

6. A process for preparing an aqueous fabric softening composition according to claim 1, the process comprising the step of dispersing a molten mixture of the cationic softener and the nonionic material in water with stirring to form a dispersion.

* * * * *